United States Patent [19]

Yoshida

[11] 4,428,147

[45] Jan. 31, 1984

[54] DOMINO TOPPLING TOY

[75] Inventor: Takashi Yoshida, Tokyo, Japan

[73] Assignee: Kabushiki Kaisha Takemi, Tokyo, Japan

[21] Appl. No.: 367,058

[22] Filed: Apr. 9, 1982

[51] Int. Cl.[3] ..... A63H 33/00

[52] U.S. Cl. ..... 46/1 R; 273/86 R; 273/129 W

[58] Field of Search ..... 46/1 R, 39, 43; 124/79; 273/129 S, 129 T, 287, 283, 86 R, 86 D, 129 R, 129 V, 129 W

[56] References Cited

U.S. PATENT DOCUMENTS 2,776,835 1/1957 Wilson ..... 273/86 R
3,315,404 4/1967 Rosen ..... 46/1 R X
3,612,527 10/1971 Rogerson ..... 273/86 R
3,973,774 8/1976 Breslow et al. ..... 124/79

*Primary Examiner*—Mickey Yu
*Attorney, Agent, or Firm*—Armstrong, Nikaido, Marmelstein & Kubovcik

[57] ABSTRACT

A domino toppling toy is provided which comprises a housing, an actuation lever and a plurality of domino toppling levers. The actuation lever is pivotally mounted on the housing and is responsive to the toppling movement of one domino train. The plurality of domino toppling levers causes the other domino trains corresponding to each domino toppling lever to topple at the same time in response to the movement of the actuation lever. The both levers are received in part in the housing of a cylindrical shape.

5 Claims, 4 Drawing Figures

DOMINO TOPPLING TOY

BACKGROUND OF THE INVENTION

The present invention relates generally to a domino toppling toy. More specifically, the invention relates to a domino toppling appliance which is capable of distributing toppling force of one domino train to the other plural domino trains.

A domino toppling game is one of the most popular amusements. In order to make a domino toppling game more interesting or attractive, there have been developed various appliances for use in a domino toppling game. A novel appliance has long been desired which is used for distributing toppling force of one domino train to a plurality of the other domino trains, thereby toppling simultaneously a plurality of the other domino trains in response to the toppling of the one domino train, and changing over the toppling direction of the one domino train to those of the plurality of the other domino trains.

SUMMARY OF THE INVENTION

Therefore, it is an object of the present invention to provide a domino toppling toy which causes in response to the toppling of one domino train a plurality of the other domino trains to be toppled simultaneously with each other.

To accomplish the above-mentioned and other objects of the invention, there is provided a domino toppling toy comprising: a housing defining an internal space therein; an actuation lever having a first outer portion extending from the housing and a first inner portion extending into the internal space and being pivotally mounted on the housing so that when a first domino train acts on the first outer portion the actuation lever pivots to raise the first inner portion; and a plurality of domino toppling levers, each lever having a second outer portion extending from the housing and a second inner portion extending into the internal space, and being pivotally mounted on the housing so that when the first inner portion is raised the second inner portion is also raised allowing each lever to pivot, whereby a plurality of the other domino trains are urged to topple by respective second outer portions.

In the preferred embodiment, the actuation member and the domino toppling members are received in part in a housing of a cylindrical configuration.

The present invention will be understood more fully from the detailed description given hereinbelow and from the accompanying drawings of the preferred embodiment of the invention which, however, should not be understood as limitative to the invention but for elucidation and explanation only.

DESCRIPTION OF THE PREFERRED EMBODIMENT

Figure 1:
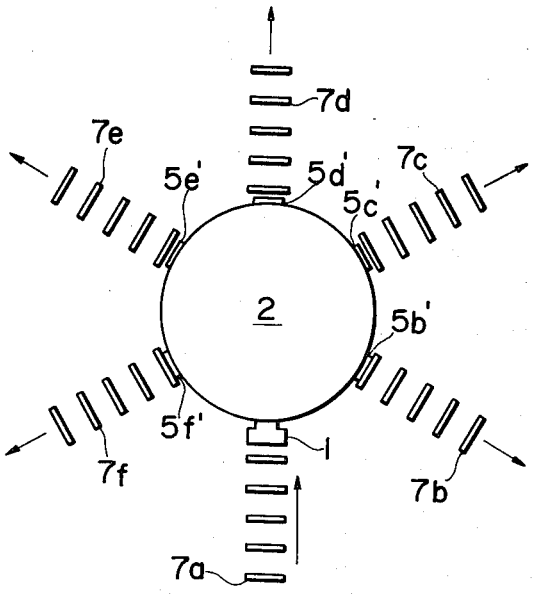
FIG. 1 is a plan view of the preferred embodiment of a domino toppling toy in accordance with the present invention.
Figure 2:
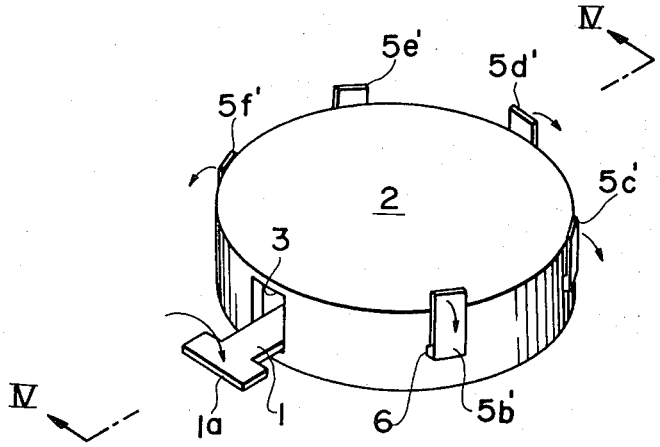
FIG. 2 is a perspective view of the domino toppling toy of FIG. 1.

Referring now to the drawings, particularly to FIG. 1, there is illustrated a preferred embodiment of the domino toppling toy according to the present invention. The domino toppling toy is mainly comprised of a housing 2, an actuation lever 1, and a plurality of domino toppling levers 5*b* to 5*f*. The housing 2 is of a cylindrical shape with a rectangular opening 3 and a plurality of slots 6 formed in the wall of the housing 2. The actuation lever 1 has an outer head portion 1*a* and a generally circular inner portion 1*b*. The actuation lever 1 is being inserted into the housing 2 through the rectangular opeing 3. Each of the domino toppling levers 5*b*, 5*c*, 5*d*, 5*e* and 5*f* is being inserted into the housing 2 through the slots 6. The domino toppling levers 5*b*, 5*c*, 5*d*, 5*e* and 5*f* are respectively provided with vertically and upwardly bent outer portions 5*b*', 5*c*', 5*d*', 5*e*' and 5*f*'. The outer portions 5*b*', 5*c*', 5*d*', 5*e*' and 5*f*' of the domino toppling levers 5*b*, 5*c*, 5*d*, 5*e* and 5*f* are respectively facing to one of the domino pieces of respective domino trains 7*b*, 7*c*, 7*d*, 7*e* and 7*f*.

Figure 3:
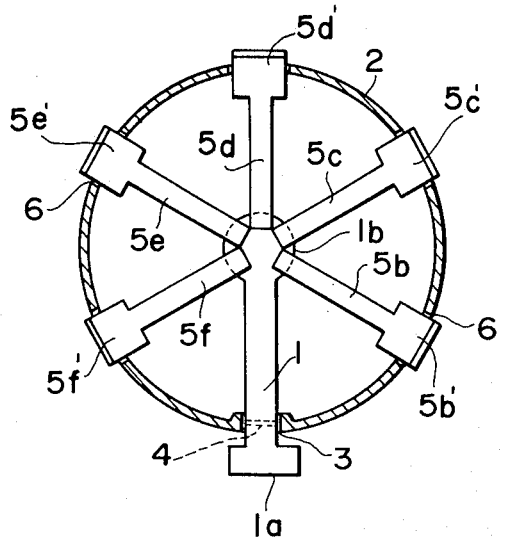
FIG. 3 is a plan view of the domino toppling toy of FIG. 1, in which a ceiling of a housing is taken out for showing the internal construction of the toy.
Figure 4:
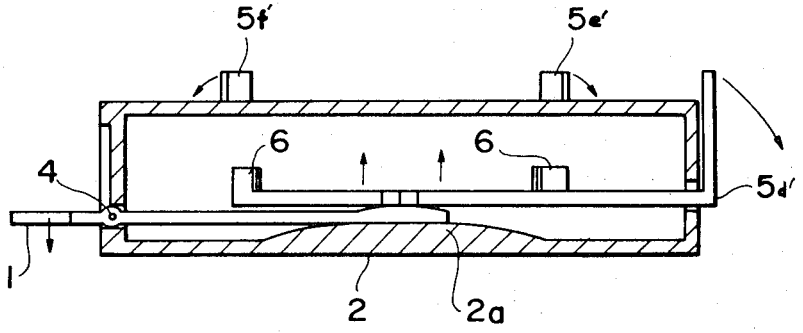
FIG. 4 is a section of the domino toppling toy of FIG. 1 taken along line IV—IV of FIG. 2.

As shown in FIGS. 3 and 4, the actuation lever 1 is pivoted at the opening 3 around a pivot axle 4. The inner portions of the domino toppling levers 5*b*, 5*c*, 5*d*, 5*e* and 5*f* are disposed to abut to the inner portion 1*b* of the actuation lever 1. Since the domino toppling levers 5*b*, 5*c*, 5*d*, 5*e* and 5*f* have respectively major sections heavier than the bent outer portions 5*b*', 5*c*', 5*d*', 5*e*' and 5*f*', the major section or inner portion normally urges the circular inner portion 1*b* of the actuation lever 1 downwardly, to the upwardly protruding rest 2*a* of the housing.

The outer portion 1*a* of the actuation lever 1 is pushed down by a domino piece when the toppling movement of a domino train 7*a* is started.

When the last domino piece falls onto the outer portion 1*a* of the actuation lever 1, the latter pivots about the pivot axle 4 thereby causing an upward motion of respective inner portions of the domino toppling levers 5*b*, 5*c*, 5*d*, 5*e* and 5*f*. Then, each domino toppling lever 5*b*, 5*c*, 5*d*, 5*e* and 5*f* turns about the slot 6 to rotate the bent outer portion 5*b*', 5*c*', 5*d*', 5*e*' and 5*f*'. By turning the outer portions 5*b*', 5*c*', 5*d*', 5*e*' and 5*f*', the domino trains 7*b*, 7*c*, 7*d*, 7*e* and 7*f* are toppled at the same time.

In the shown embodiment, the domino trains are radially arranged with respect to the housing and are equally spaced with each other. Though the housing of the embodiment is illustrated as having a circular cross section, this can be substituted for any housings having various shapes. Further, the lever construction may include any possible modifications without departing from the principle of the invention as recited in the appended claims.

What is claimed is:

1. A domino toppling toy comprising:

a housing defining an internal space therein;

an actuation lever having a first outer portion extending from said housing and a first inner portion extending into said internal space, and being pivotally mounted on said housing so that when a first domino train acts on said first outer portion said actuation lever pivots to raise said first inner portion; and a plurality of domino toppling levers, each lever having a second outer portion extending from said housing and a second inner portion extending into said internal space, and being pivotally mounted on said housing so that when said first inner portion is raised said second inner portion is also raised allowing said each lever to pivot, whereby a plurality of the other domino trains are urged to topple by respective said second outer portions.

2. A domino toppling toy as set forth in claim 1, wherein said housing has an opening through which said actuation lever is extending; and said housing has respective slots through which said plurality of domino toppling levers are extending.

3. A domino toppling toy as set forth in claim 2, wherein said actuation lever is provided with an axle for pivotal movement thereabout, said axle being supported at said opening formed in said housing; and each of said domino toppling levers is so formed that said second outer portion extending out of said housing is bent substantially perpendicularly to said second inner portion, whereby the intermediate section between said second inner and outer portions serves as a fulcrum at said slot formed in said housing.

4. A domino toppling toy as set forth in any one of claims 1 to 3, wherein said housing is generally of a circular cross section.

5. A domino toppling toy as set forth in claim 4, wherein said opening and slots are formed in said housing in radial alignment with each other.

* * * * *